US010159395B1

(12) United States Patent
Yusuf

(10) Patent No.: US 10,159,395 B1
(45) Date of Patent: Dec. 25, 2018

(54) DIRT, DUST, HAIR, AND DEBRIS COLLECTION APPARATUS

(71) Applicant: Osman Yusuf, Austin, TX (US)

(72) Inventor: Osman Yusuf, Austin, TX (US)

( * ) Notice: Subject to any disclaimer, the term of this patent is extended or adjusted under 35 U.S.C. 154(b) by 0 days.

(21) Appl. No.: 15/463,366

(22) Filed: Mar. 20, 2017

(51) Int. Cl.
*A47L 13/40* (2006.01)
*A47L 25/00* (2006.01)
*A47L 13/51* (2006.01)

(52) U.S. Cl.
CPC ..... *A47L 13/40* (2013.01); *A47L 13/51* (2013.01); *A47L 25/005* (2013.01); *A46B 2200/302* (2013.01)

(58) Field of Classification Search
CPC ..... A47L 13/40; A47L 13/51; A47L 25/005; A46B 2200/302; A46B 2200/3026; B08B 6/00
USPC ..... 15/104.002, 159.1–160, 1.51–1.52
See application file for complete search history.

(56) References Cited

U.S. PATENT DOCUMENTS

| | | | | |
|---|---|---|---|---|
| 3,568,233 | A * | 3/1971 | Terzian | A47L 13/50 15/105 |
| 4,145,787 | A * | 3/1979 | Bastian | A46B 3/16 15/206 |
| 4,441,228 | A | 4/1984 | Marquart et al. | |
| 5,280,664 | A | 1/1994 | Lin | |
| 6,258,455 | B1 | 7/2001 | Clarke | |
| 2003/0164176 | A1 | 9/2003 | Arbon | |
| 2006/0054187 | A1* | 3/2006 | Morse | A47L 11/00 134/6 |
| 2011/0226638 | A1* | 9/2011 | Hoadley | A46B 5/0075 206/229 |
| 2014/0259491 | A1 | 9/2014 | Colangelo | |

* cited by examiner

*Primary Examiner* — Laura C Guidotti

(57) ABSTRACT

A lightweight, pliable, and disposable cleaning apparatus is disclosed that is in the shape of a ball to assist with cleaning any type of dust, dirt, or debris from a floor or carpeted area. In particular, the cleaning apparatus can include a core region and several bristles secured to the core region, wherein the bristles form a round configuration for the cleaning apparatus. In addition, the bristles can include an electrostatic charge and additional adhesive properties to help with collecting and adhering to any type of debris, among other advantages.

18 Claims, 7 Drawing Sheets

DIRT, DUST, HAIR, AND DEBRIS COLLECTION APPARATUS

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Various cleaning devices, equipment, tools, and the like have been introduced as a goal to help reduce the time and effort in cleaning, as well as in improving the efficiency of the effort applied. For example, these include traditional dry brooms and dust pans, wet/dry cleaning cloths attached to broom sticks, wet mops, and vacuum suction cleaners, among others. In the case of brooms and dust pans, one must continually sweep the accumulated dust and debris into a pile, and then bend over to sweep the accumulated dust and debris into a dust pan, of which also by nature is not completely effective as some accumulated dust and debris can still remain embedded in the broom itself and left on the floor due to the design of brooms and dustpans and effort applied. In the case of wet or dry cleaning cloths attached to broom sticks, one must continually and frequently stop and remove and re-install new cleaning cloths to the broom stick, of which also isn't completely effective due to the design, which simply pushes the accumulated debris and dust around and not accumulate it due to the prevailing flat design of the apparatus. In the case of traditional wet mops, one must frequently rinse and wring the mops in a bucket of water or a cleaning solution. As such, the conventional methods and apparatuses for cleaning floors or carpeted areas leave little to be desired, are time-consuming, ineffective, requiring too much effort and in some instances counter-productive.

Hence, what is needed is a simple cleaning apparatus that allows a user to efficiently and quickly clean a floor or carpeted area without the inconvenience of conventional methods.

BRIEF SUMMARY

In one aspect of the present disclosure described herein, a lightweight, pliable, and disposable cleaning apparatus is disclosed that is in the general shape of a ball or round configuration to assist with cleaning any type of dust, dirt, hair or debris from a floor or carpeted area. In particular, the cleaning apparatus can include an inner region and several bristles and webbing secured to the inner region, wherein the bristles and webbing form a spherical configuration for the cleaning apparatus. In addition, the inner region, bristles and webbing can include an electrostatic charge and additional adhesive and entrapping properties to help with collecting, adhering to and entrapping any type of dust, dirt, hair or debris, among other advantages.

In another aspect of the disclosure described herein, a cleaning apparatus is disclosed having an inner core region and a plurality of bristles secured to the inner core region, wherein the bristles form a spherical configuration around the inner core for the cleaning apparatus. In addition, the apparatus may also include wherein the bristles have an electrostatic charge to assist in collecting debris. Further, the bristles may have a positive or negative charge. In addition, the bristles may further include microfiber strands. Further, bristles may include adhesive properties. In addition, the bristles may also include interwoven strands or webbing between each of the bristles. Here, a distal region of the bristles may include the microfiber strands. In addition, a proximal region of the bristles may include the adhesive properties. Further, the interwoven strands may also include debris entanglement properties adapted to entangle debris therein. Here, the cleaning apparatus may further include hand-held a broom. In addition, the cleaning apparatus may also include a sealed container for housing the cleaning apparatus, wherein the sealed container is pre-charged with an electrostatic charge. Further, a powered charging station may be included for actively charging the bristles of the cleaning apparatus. In addition, a container having a cleaning or adhesive solution may be included, wherein the bristles of the cleaning apparatus are submerged therein. Further, the cleaning apparatus may include a container comprising water, wherein the bristles of the cleaning apparatus are submerged therein to activate adhesive properties of the cleaning apparatus.

In another aspect of the disclosure described herein, a cleaning apparatus is disclosed having an inner or interior region, and a plurality of bristles and interwoven strands secured to the inner region, wherein the bristles form an approximate spherical configuration for the cleaning apparatus. In addition, the inner region can also include adhesive properties configured to assist in collecting debris. Further, the bristles may also include an electrostatic charge to assist in collecting debris. In addition, the interwoven strands may include entanglement properties to assist in collecting debris.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
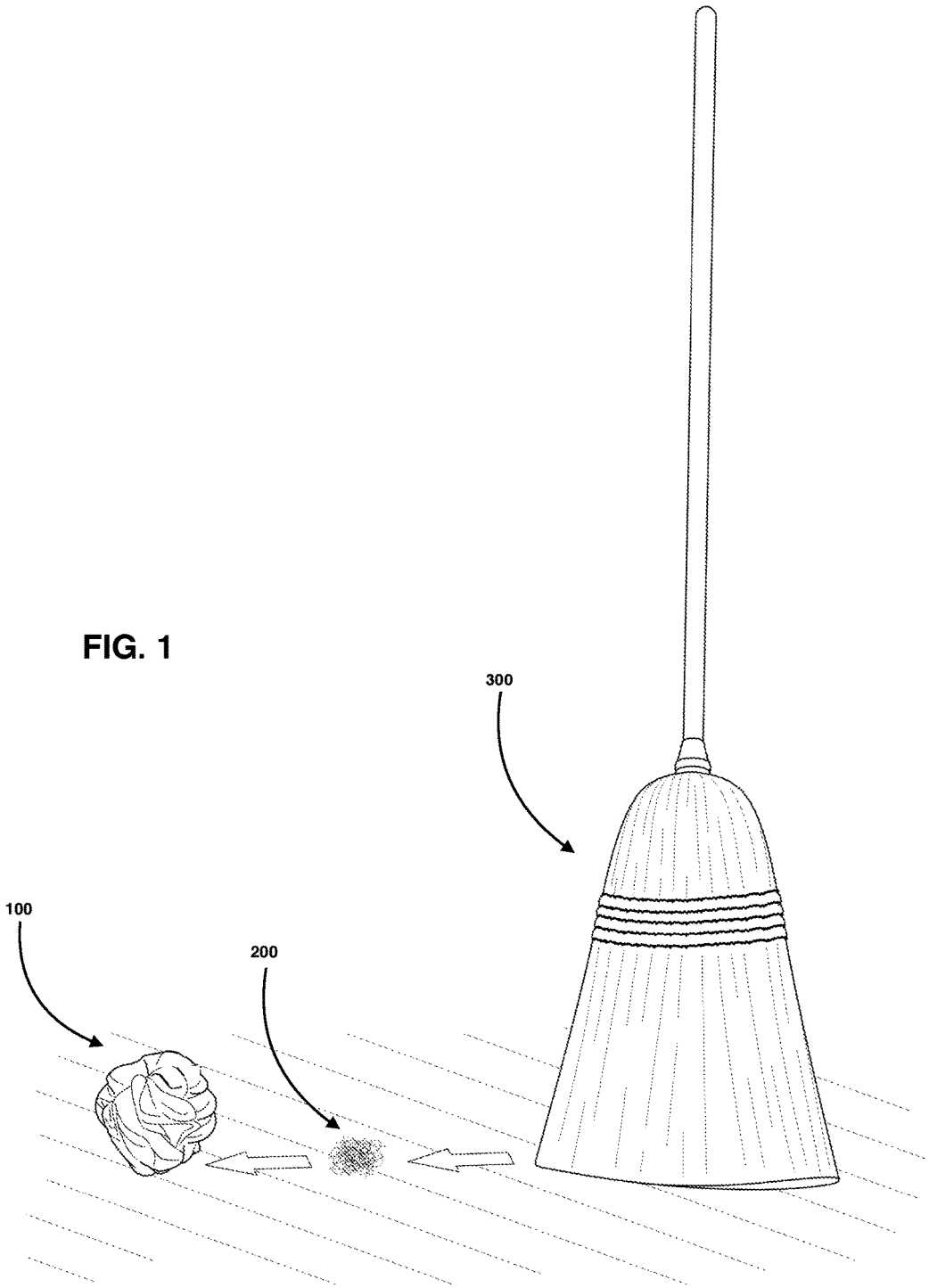
FIG. 1 illustrates a perspective view for one non-limiting embodiment of the dirt, dust, hair, and debris collection apparatus of the disclosure described herein shown in combination with a broom.
Figure 1A:
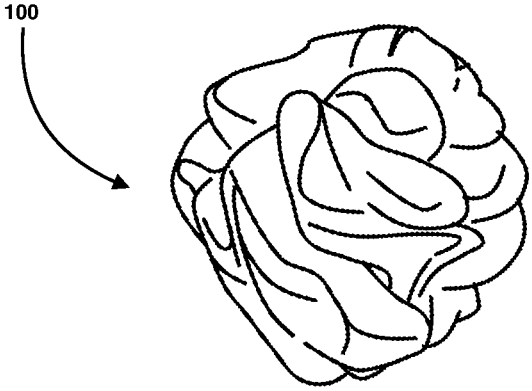
FIGS. 1A-1C illustrate front views for alternative configurations of the dirt and dust collection apparatus of the disclosure described herein.
Figure 1B:
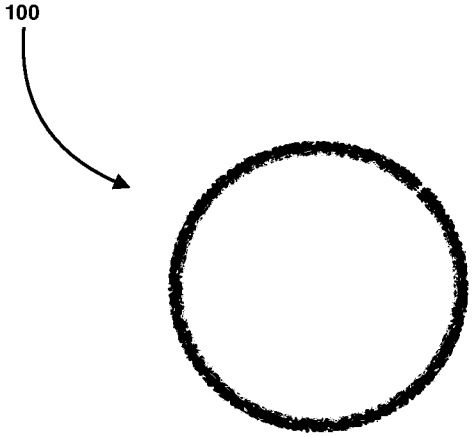
Figure 1C:
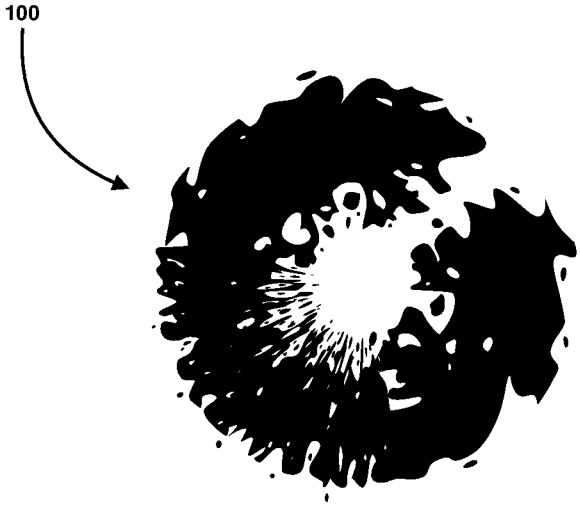

FIG. 1 illustrates one embodiment for the dust and dirt collection apparatus 100 of the disclosure described herein. Here, apparatus 100 is shown having a general round or spherical shape configuration that allows it to be either rolled or moved around on a floor area, such as via broom 300. In particular, apparatus 100 is configured to be used in conjunction with a broom, wherein the broom can sweep any type of dust, dirt, particles, objects, or debris 300 towards apparatus 100. In addition, apparatus 100 includes several properties that allow it to collect various types of dust, dirt, or debris having any shape, size, or weight. FIGS. 1A-1B illustrate alternative configurations for the round or spherical configuration of apparatus 100, including various exterior textures, ranging from high density bristles for a soft texture to low density bristles for hard or rough texture. Here, apparatus 100 can generally be anywhere from one inch up to and including 30 inches in diameter or length. However, apparatus 100 may take any other shape, size, or dimensions, depending on the application for its use.

Figure 2:
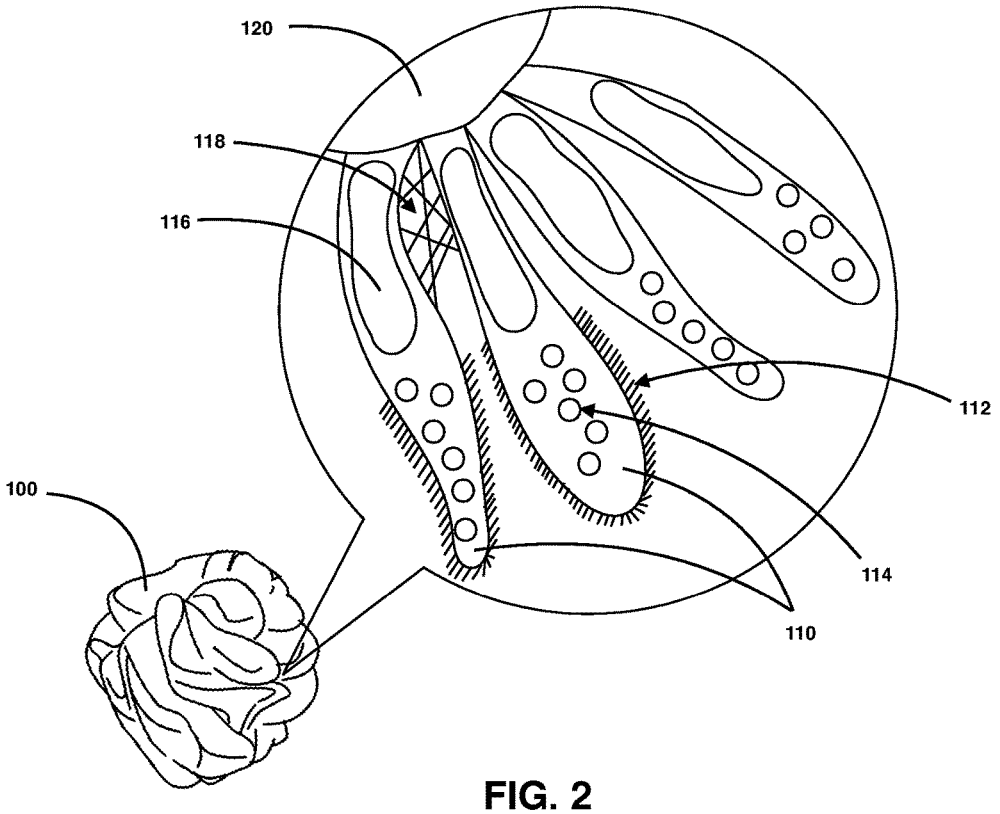
FIG. 2 illustrates a partial close-up perspective view for one or more strands and bristles.

FIG. 2 illustrates a close-up view of an area of apparatus 100. In particular, apparatus 100 is shown having a plurality of bristles and strands 110 fixed to an inner spherical core or interior region 120. Here, each bristle or strand can include a plurality additional strands 112 may be made of microfiber polymers, or ultra microfibers, and/or combination of microfiber with polyester or cotton materials. Further, strands 112 may also be interwoven or knitted have diameters anywhere ranging from 1-20 microns, preferably approximately three microns. In addition, each strand 110 and microfiber 112 may also be electrostatically charged, such as having a cationic or positive charge, to attract dust, bacteria, pollen, oxidation, metals, or any other debris having anion or negative charge. In addition, the distal end regions of strands 110 may hold most of the charged particles 114, whether it be a positive or negative charge. In addition, apparatus 100 may also include packaging or a charging station that allows it to be electrically charged, which will later be described in the disclosure. Further, particles 114 may also have magnetic properties. In general, the distal regions of strands 110 are adapted to collect lighter weight debris, whereas the proximal regions of bristles or strands 110 are configured to collect larger or heavier debris. However, it is contemplated within the scope of the disclosure that bristles 110 may have any of the one or more aforementioned properties located anywhere on each bristle or encompassing the entire strand or bristle. In addition, each bristle or strand may have any type of cross-section, such as round, square, triangular, or an asymmetrical configuration. In addition, each bristle or strand may have either sharp or rounded corners or edges. Further, each bristle or strand may have any type of rough or smooth texture, in addition to any type of elasticity or malleability.

Still referring to FIG. 2, strands 110 may further include adhesive regions 116 near the proximal region of strands 110. Here, regions 116 may include any type of adhesive or "sticky" property that allows it cling on to various types of debris that would not otherwise been collected or held by the distal regions of the strands 110. For example, in a method of use, when a large piece of debris is encountered, apparatus 100 may be compressed or pressed-down into the debris on the floor, thereby bypassing the distal end regions 114 and allowing the debris to make direct contact with adhesive regions 116 near the core and adhering thereto. In addition, apparatus 100 may further include a webbing of interwoven strands 118, such as micro-fiber or any polymer that may or may not include an electrostatic charge or adhesive properties. Here, interwoven strands 118 are secured to and in between a pair, plurality, or a cluster of strands 110, near the proximal area of the strands and/or also attached to the core region 120. For example, interwoven strands 118 can provide additional surface area to allow for larger, asymmetrically shaped, or more rigid debris to be collected and held within apparatus 100. Further, the core region 120 of apparatus 100 may include electrical properties or be powered, such that it can generate a charge to be transmitted to bristles 110. For example, the core region 120 may include an input interface that allow a user to connect a wire thereto to charge it, or alternatively include a battery therein.

Figure 3:
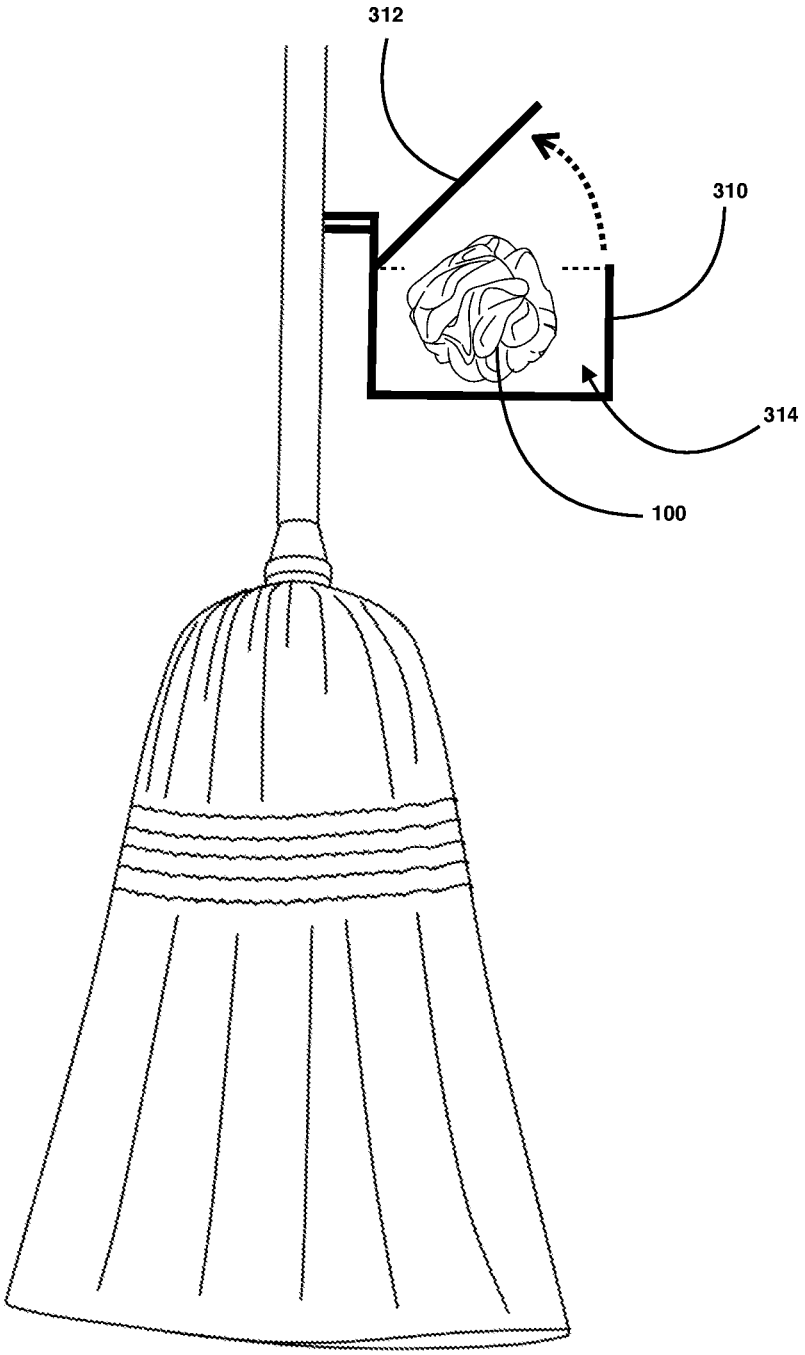
FIG. 3 illustrates partial cross-sectional side view of a storage and dispensing attachment for the dirt and dust collection apparatus of the disclosure described herein.

FIG. 3 illustrates one embodiment for a storage or dispensing compartment 310 for housing apparatus 100 of the disclosure described herein. In particular, compartment 310 may one or more brackets or attachment points for being secured to a broom. In addition, compartment 310 may include a pivoting lid or cover 312. In addition, compartment 310 may include any type of cleaning solution within space 314 for either cleaning apparatus 100 or applying a cleaning solution thereto. In addition, compartment 310 may also be used to electrically charge apparatus 100.

Figure 4A:
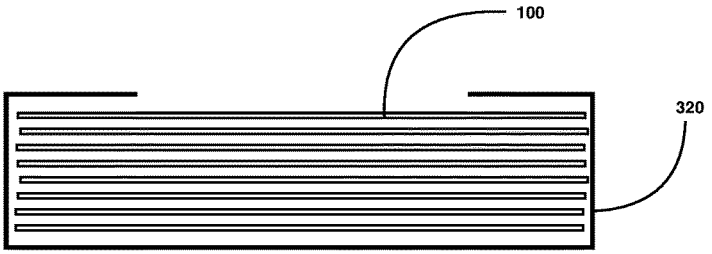
FIGS. 4A-4C illustrate partial cross-sectional side views of a dispensing compartment and packaging for the dirt and dust collection apparatus of the disclosure described herein, wherein the apparatus can expand upon being dispensed from the compartment and packaging.
Figure 4B:
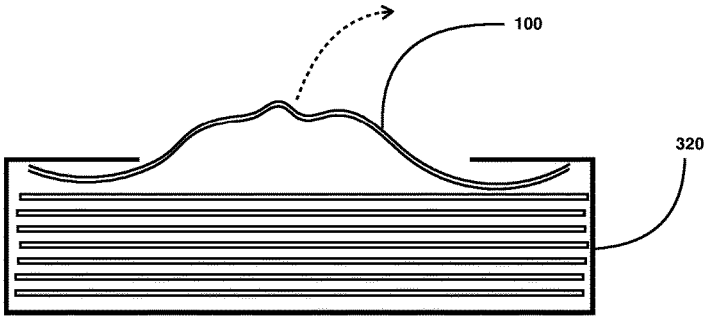
Figure 4C:
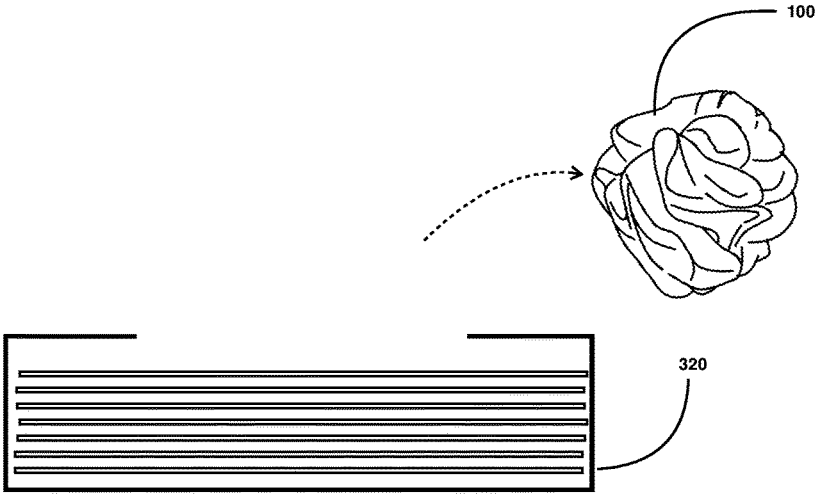

FIGS. 4A-4B illustrates one embodiment of packaging for dispensing the dirt and dust cleaning apparatus 100 of the disclosure described herein. Here, packaging and storage container 320 may include a plurality of apparatus' 100 stacked on top of each other in a flat sheet type, layered, stacked, or compacted form. As each individual sheet of apparatus 100 is pulled by the user from the container, the apparatus 100 will conform to its pre-defined or pre-configured shape or form, as shown in FIG. 4C. Specifically, each flat sheet of apparatus 100 may be compressed and packed under pressure within container 320, and as a user pulls each apparatus 100 out of the container, the apparatus 100 forms to its intended shape and configuration since it is no longer under compression. For example, the flexible materials of apparatus 100 can have flexible, pliable, elastic, and spring-like properties that allow it form to its intended or original shape when it is no longer packed or compressed under pressure or weight. Alternatively, each apparatus 100 may include pre-defined creases, scores, or perforations that allow a user to simply shape or roll apparatus 100 into its intended configuration prior to use. In addition, apparatus 100 may either be pre-moistened or dry within packaging 320.

Figure 5A:
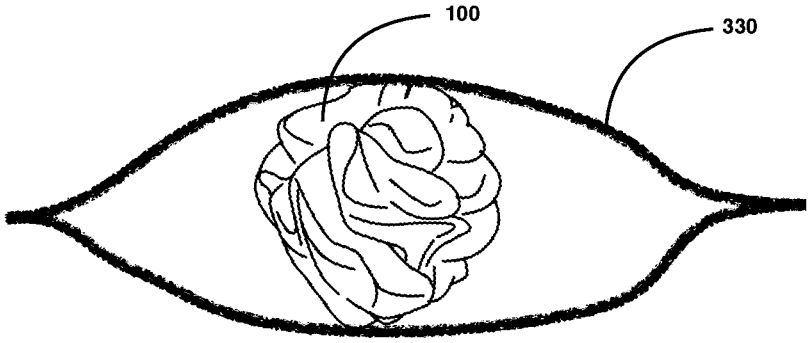
FIG. 5A-5B illustrates partial cross-sectional side view of another compartment and packaging for the dirt and dust collection apparatus of the disclosure described herein, wherein the apparatus can be electrostatically charged via the packaging.
Figure 5B:
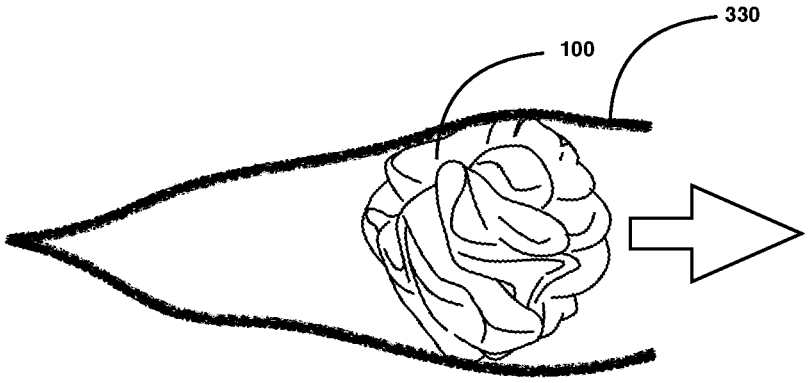

FIGS. 5A-5B illustrate another embodiment for packaging of apparatus 100 of the disclosure described herein. Here, sealed packaging material 330 may include material within its interior space, such as a fibrous, microfiber material, or metal material, that has been electrostatically charged, such as a with a cationic (positive) charge. In particular, the rubbing and friction motion of bristles of apparatus 100 against the interior space of packaging 330 allows apparatus 100 to be charged not only while it is held within packaging 330 but also as packaging 330 is opened and apparatus 100 is pulled out. Specifically, as apparatus 100 is being pulled out of the packaging, the bristles of apparatus 100 rub against the interior space of packaging 330, further electrostatically charging it. In addition, packaging 330 may also have a much more compact configuration thereby compressing apparatus 100 to provide more contact with its interior space and improve its charge. Further, the exterior surface of packaging 330 may also carry a charge, thereby allow a user to rub apparatus 100 against its exterior surface to improve its charge. In other embodiments, the interior of packaging 330 may be moistened or comprising cleaning solution fluids, or adhesive fluids, such that apparatus 100 is pre-moistened or includes pre-cleaning soapy or adhesive solution and properties prior to its use.

Figure 6A:
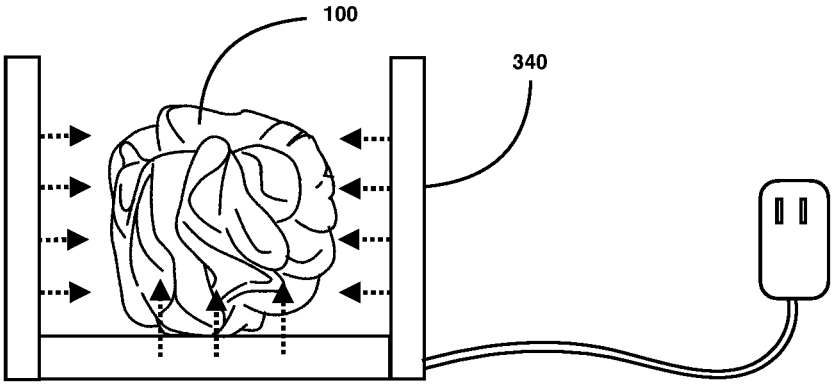
FIG. 6A illustrates a partial cross-sectional side view for a powered electrostatic charging station for the dirt and dust collection apparatus of the disclosure described herein.
Figure 6B:
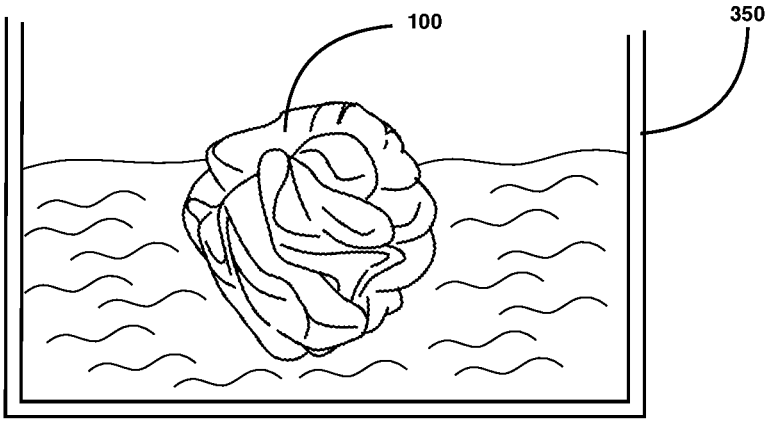
FIG. 6B illustrates a partial cross-sectional side view for a cleaning solution compartment for the dirt and dust collection apparatus of the disclosure described herein.

FIG. 6A illustrates one embodiment for an independent charging station for apparatus 100. In particular, charging station 340 may be powered thereby allowing apparatus 100 to be actively charged, with either a positive or negative charge. Specifically, each side wall of station 340 may include any type of coils or inductive charging components to accelerate charging of apparatus 100. FIG. 6B illustrates one embodiment for a cleaning station for apparatus 100. In particular, cleaning station or container 350 may include any type of chemical solution that can either assist in cleaning or releasing the debris collected onto apparatus 100, in the instance that apparatus 100 may be re-used. Further, station 350 may also be packaging for apparatus 100, wherein apparatus 100 is submerged within a fluid solution while it is in its packaging so that it is ready for use upon removing it from the packaging. In addition, the solution within container may be such that it improves the apparatus' 100 adhesion or adhesive components or properties, such as applying additional adhesive to parts 116, as shown in FIG. 2, among other uses.

Having thus described the several embodiments of the present disclosure described herein, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention. Although the present disclosure described herein has been described in considerable detail with reference to certain preferred versions or embodiments thereof, other versions and embodiments are possible. Therefore, the spirit and scope of the appended claims should not be limited to the description of the embodiments contained herein.

What is claimed is:

1. A cleaning apparatus, comprising:
an inner region;
a plurality of bristles secured to the inner region;
wherein the bristles further comprise an adhesive property configured to assist in collecting debris;
wherein the bristles further comprise an electrostatic charge to assist in collecting debris;
a plurality of interwoven strands; and
wherein the interwoven strands further comprise entanglement properties to assist in collecting debris.

2. The cleaning apparatus of claim 1, wherein the bristles comprise a positive or negative charge.

3. The cleaning apparatus of claim 1, wherein the bristles further comprise microfiber strands.

4. The cleaning apparatus of claim 1, wherein a proximal region of the bristles comprise the adhesive property.

5. The cleaning apparatus of claim 1, wherein the interwoven strands are between each of the bristles.

6. The cleaning apparatus of claim 3, wherein a distal region of the bristles comprises the microfiber strands.

7. The cleaning apparatus of claim 4, wherein a proximal region of the bristles comprise the adhesive property.

8. The cleaning apparatus of claim 5, wherein the entanglement properties are comprised of a webbing configuration.

9. The cleaning apparatus of claim 1, further comprised of a spherical or round configuration.

10. The cleaning apparatus of claim 1, wherein the bristles of the cleaning apparatus are pre-charged with the electrostatic charge.

11. The cleaning apparatus of claim 1, wherein the bristles are configured to be actively charged.

12. A cleaning apparatus, comprising:
an inner region;
a plurality of bristles and interwoven strands secured to the inner region, wherein the bristles form an approximate spherical configuration for the cleaning apparatus;
the inner region further comprising adhesive properties configured to assist in collecting debris;
the bristles further comprising an electrostatic charge to assist in collecting debris; and
wherein the interwoven strands comprise entanglement properties to assist in collecting debris.

13. A cleaning system, comprising:
a cleaning apparatus having an inner region, a plurality of bristles secured to the inner region, wherein the bristles further comprises an adhesive property configured to assist in collecting debris, and wherein the bristles further comprise an electrostatic charge to assist in collecting debris;
the cleaning apparatus further comprising a plurality of interwoven strands, wherein the interwoven strands further comprise entanglement properties to assist in collecting debris.

14. The cleaning system of claim 13, further comprising a broom to be used in conjunction with the cleaning apparatus.

15. The cleaning system of claim 13, further comprising a sealed container for housing the cleaning apparatus, wherein the sealed container is pre-charged with an electrostatic charge.

16. The cleaning system of claim 13, further comprising a powered charging station for actively charging the bristles of the cleaning apparatus.

17. The cleaning system of claim 13, further comprising a container comprising a cleaning or adhesive solution, wherein the bristles of the cleaning apparatus are submerged therein.

18. The cleaning apparatus of claim 13, further comprising a container comprising water, wherein the bristles of the cleaning apparatus are submerged therein to active the adhesive properties of the cleaning apparatus.

* * * * *